US005400008A

United States Patent [19]

Toohey

[11] Patent Number: 5,400,008

[45] Date of Patent: Mar. 21, 1995

[54] LOCATION MARKER

[76] Inventor: James T. Toohey, 185 Seven Hills Road, Baulkham Hills, New South Wales 2153, Australia

[21] Appl. No.: 777,230

[22] PCT Filed: May 3, 1990

[86] PCT No.: PCT/AU90/00181

§ 371 Date: Jan. 3, 1992

§ 102(e) Date: Jan. 3, 1992

[87] PCT Pub. No.: WO90/13879

PCT Pub. Date: Nov. 15, 1990

[30] Foreign Application Priority Data

May 5, 1989 [AU] Australia ..... PJ4060
Nov. 15, 1989 [AU] Australia ..... PJ7404

[51] Int. Cl.[6] ..... G08B 23/00

[52] U.S. Cl. ..... 340/321; 340/331; 340/691; 340/983; 200/61.45 M; 200/61.46; 200/61.85; 200/410; 335/17; 362/158; 362/170; 362/109; 362/114

[58] Field of Search ..... 340/321, 337, 691, 693, 340/983, 984, 981; 200/61.45 M, 61.46, 61.85, 410, 414; 362/157, 158, 170, 171, 174, 102, 109, 114; 335/15, 17, 18

[56] References Cited

U.S. PATENT DOCUMENTS

| | | | |
|---|---|---|---|
| 2,305,161 | 12/1942 | Hieronymus | 340/321 |
| 2,335,852 | 12/1943 | Frank | 340/321 |
| 2,521,723 | 9/1950 | Hubbell | 200/87 |
| 2,773,171 | 12/1956 | Pennow . | |
| 2,905,863 | 9/1959 | Martin et al. . | |
| 3,292,039 | 12/1966 | Horino . | |
| 3,486,071 | 12/1969 | Hedge | 315/241 |
| 4,124,842 | 11/1978 | Bachelor | 340/321 |
| 4,142,179 | 2/1979 | Lowndes | 340/321 |
| 4,369,437 | 1/1983 | Thompson, Jr. et al. | 340/547 |
| 4,422,016 | 12/1983 | Kurple | 315/241 S |
| 4,468,656 | 8/1984 | Clifford | 340/539 |
| 4,665,386 | 5/1987 | Haws | 340/549 |
| 4,796,167 | 1/1989 | Brown | 362/158 |

FOREIGN PATENT DOCUMENTS

| | | |
|---|---|---|
| 255999 | 12/1962 | Australia . |
| 2798377 | 7/1979 | Australia . |
| 90308 | 9/1982 | Australia . |
| 7741281 | 5/1983 | Australia . |
| 2248974 | 6/1975 | France . |
| 2815033 | 10/1979 | Germany . |
| 519493 | 3/1940 | United Kingdom . |
| 698128 | 10/1953 | United Kingdom . |
| 1526931 | 10/1978 | United Kingdom . |
| 2052865 | 1/1981 | United Kingdom . |

*Primary Examiner*—Donnie L. Crosland
*Attorney, Agent, or Firm*—Ladas & Parry

[57] ABSTRACT

A location marker includes a casing, a switch assembly and a lens enclosing a flashable strobe lamp. The location marker is powered by batteries and an electronic circuit that converts the battery voltage to a trigger voltage for illumination of the strobe lamp. The switch assembly is non-intrusive and maintains water tight integrity inside the casing. The switch assembly futher includes a magnetically operable switch for selectively connecting and disconnecting two pairs of terminals. An R.F. transmitting location marker is also employed using a transmitter circuit and an antenna.

14 Claims, 12 Drawing Sheets

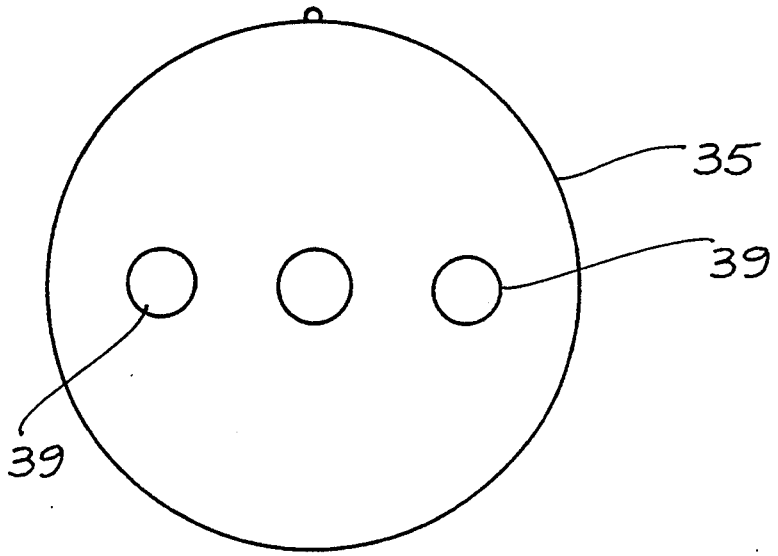
FIG. 6B
FIG. 6C
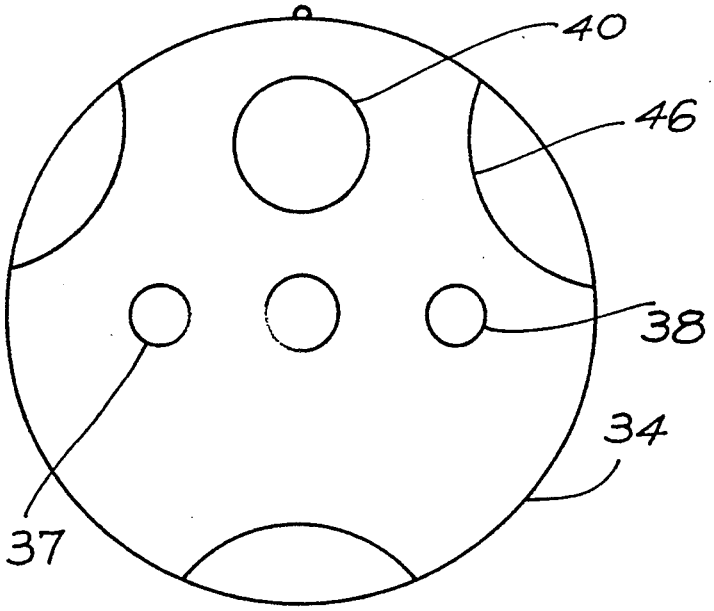

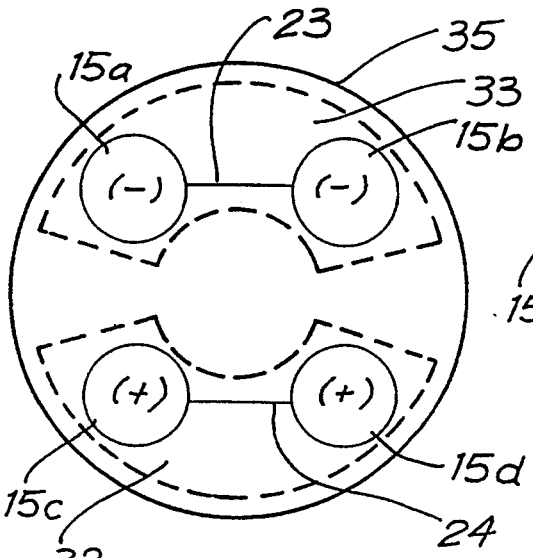
FIG. 7A
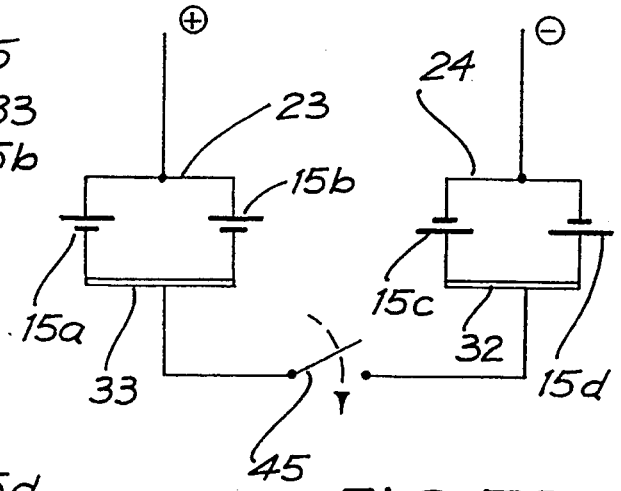
FIG. 7B
FIG. 7C
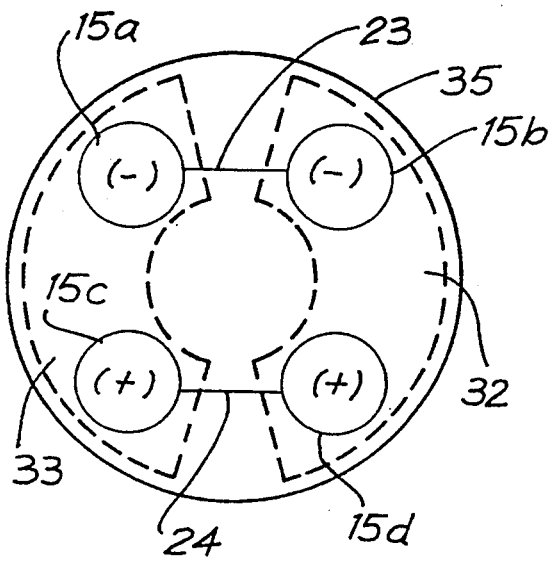
FIG. 7D
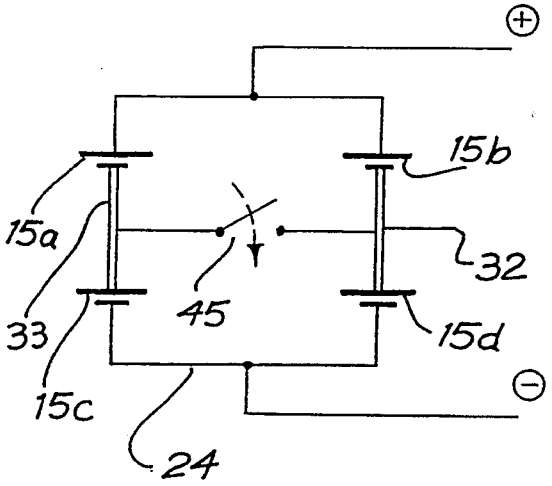

LOCATION MARKER

TECHNICAL FIELD

The present invention relates to a location marker and in particular discloses a light emitting device that can be used to indicate the location of a person or object.

Conventional light emitting devices that have been used as distress and location beacons generally utilise a flashing lamp and a battery source suppling power to the lamp. A switch circuit enables the lamp to flash pulses of light which provide an indication of distress or hazard.

However, these conventional devices suffer the problem that as the battery source dissipates its energy, the volume of light decreases for each pulse that is emitted. Also, the electronic circuit that causes the lamp to flash can consume a reasonable portion of the energy stored in the battery and hence reduces the operable period of the light emitting beacon.

SUMMARY OF THE INVENTION

It is an object of the present invention to overcome, or ameliorate the abovementioned problems through provision of a location marker having an emitting device (for example a light emitting device) that emits a constant amount of energy for each emission (flash) for the entire life of its energy supply.

In accordance with one aspect of the present invention there is disclosed a signalling device comprising:

- a housing enclosing a battery source and an electronic circuit;
- switching means adapted to connect said source to said circuit; and
- a signal emitter connected to said circuit, said circuit being adapted to derive energy from said source and to supply pulses of energy to said emitter, each said pulse providing substantially uniform energising power during the life of said source.

In accordance with another aspect of the present invention there is disclosed an electronic circuit for interconnection between a source of electrical energy and a load of electrical energy, said circuit comprising:

- blocking oscillator means having an input connected to said source and an output connected to a rectifier and filter combination, said oscillator means converting the voltage of said source to a substantially higher voltage, the output of said combination supply said load;
- timer means supplied by said source that outputs to an electronic isolation device a triggering pulse at intervals proportional to the voltage of said source, said isolation device interconnecting said timer means with a trigger device to cause a pulse of electrical energy to be dissipated by said load in response to said trigger pulse, the energy dissipated in said load being substantially equal for each consecutive pulse.

In accordance with another aspect of the present invention there is disclosed a lens formed of translucent diffusing plastics material, said lens having a substantially cylindrical body, the interior of said body being adapted for the insertion of a lamp, one end of said body being sealed by said plastics material with said seal being of such thickness so as to allow for the formation within said seal of a conical or domed structure, said lens further comprising a flange formed at the other end of said body through which said lamp can project into said body, said structure and said flange substantially increasing the dispersion of light emitted by said lamp from said lens.

In accordance with another aspect of the present invention there is disclosed a switch assembly for selectively connecting and disconnecting two pairs of terminals, said assembly comprising:

- two contact pads arranged on one surface of a contact block, each of said pads adapted to contact, in a first position, two adjacently located terminals;
- a magnetically operable switch located in said contact block that provides for electrical connection and disconnection between said contact pads;
- a boss rotatably connected to said contact block and rotatable between two positions, one of said positions aligning a magnet located within said boss with said magnetically operable switch;
- said boss and said contact block being adapted to rotate together such that each said contact pad contacts, in a second position, to adjacently located terminals.

The adaptation of the present invention to a radio frequency transmitting distress beacon is also disclosed.

BRIEF DESCRIPTION OF THE DRAWINGS

A preferred embodiment of the present invention will now be described with reference to the drawings in which:

FIG. 6B is a plan view of the contact block of FIG. 6A;

FIG. 6C is an inverted plan view of the switch boss of FIG. 6A;

FIGS. 7A to 7D illustrate different connections made by the operation of the switch of FIG. 6 in various positions;

BEST AND OTHER MODES FOR CARRYING OUT THE INVENTION

Figure 1:
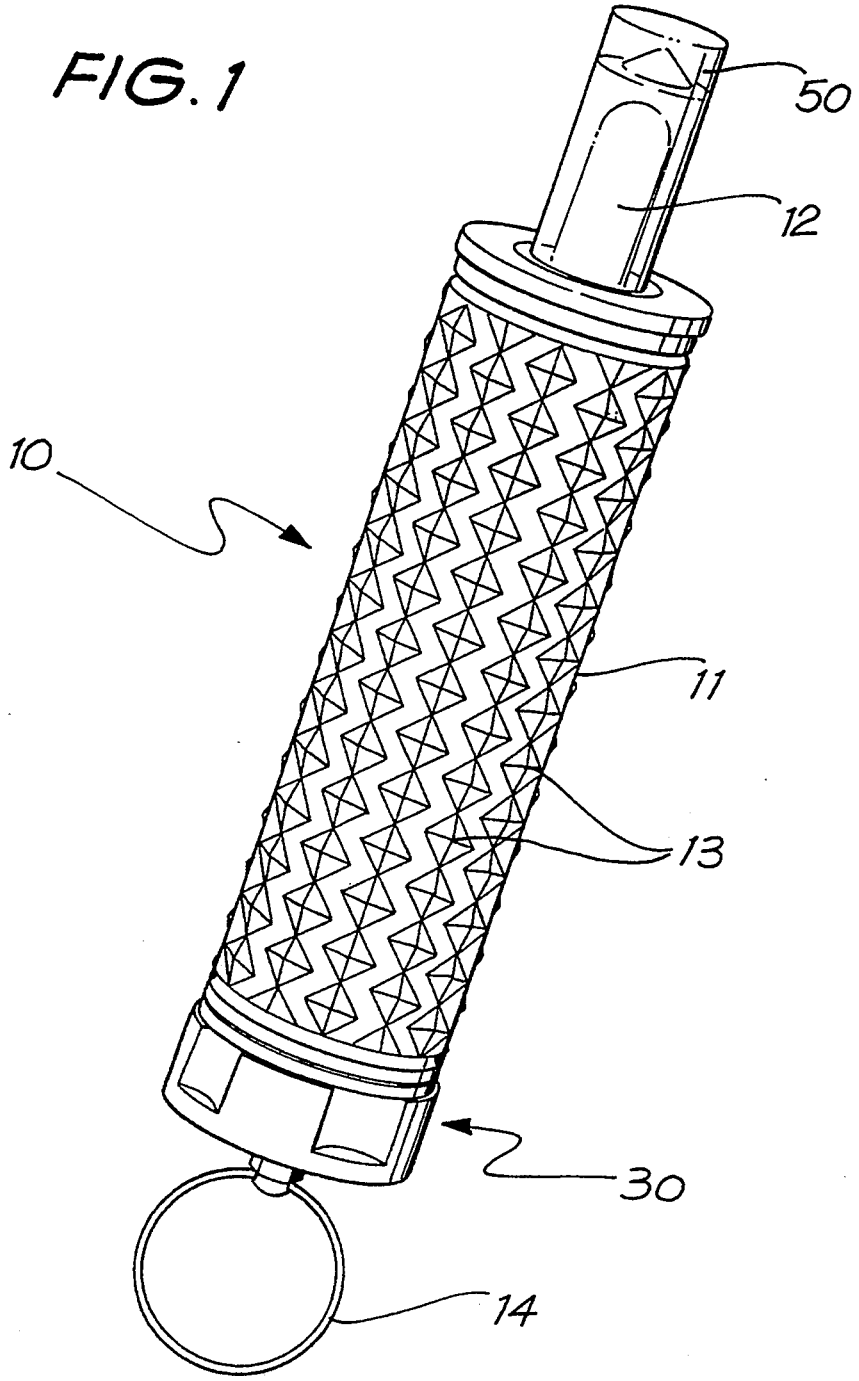
FIG. 1 illustrates a perspective view of a device of the preferred embodiment.

The location marker 10 illustrated in FIG. 1 comprises a casing II that has attached to one end a lens 50 that encloses a lamp 12. At the other end of the casing 11 is a switch cap assembly generally indicated at 30 that can be operated to cause the location marker 10 to flash. The casing 11 is preferably provided with an external configuration comprising tetrahedon structures 13 that prevent slippage when held by an operator. Also, the location marker 10 can be provided with a metal ring 14 for attachment to an object or the clothing of a person.

Figure 2:
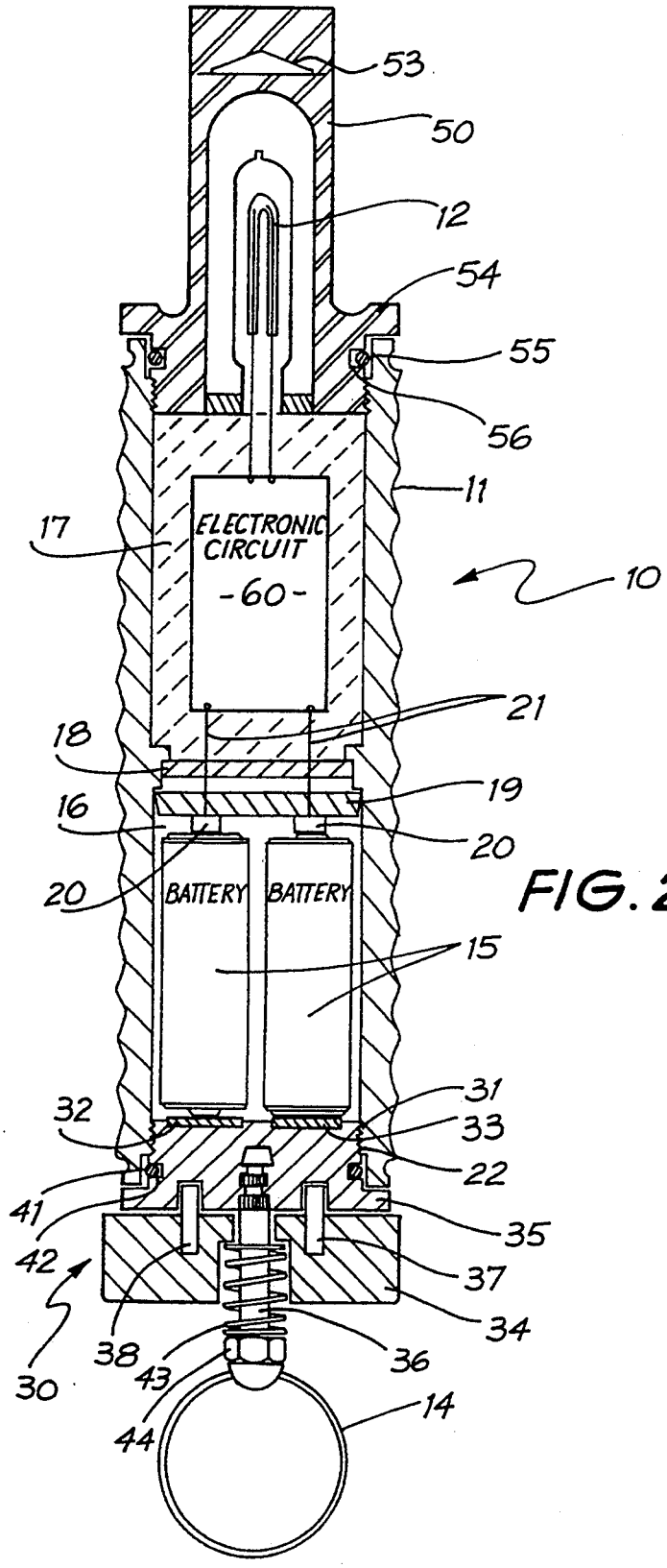
FIG. 2 illustrates a longitudinal cross section of FIG. 1.

FIG. 2 illustrates a detailed longitudinal cross section of the location marker 10 of FIG. 1. Enclosed within the casing 11 is an electronic circuit 60 that interconnects batteries 15 to the lamp 12. The electronic circuit 60 is suspended within the casing 11 by a filling material 17 that prevents damage to the electronic circuit 60 through shock or vibration. The filling material 17 can be any substance commonly used for this purpose such as silicone, rubber, or epoxy resin.

The casing 11 is divided in two portions by a wall 18 that separates the filling material 17 from the battery compartment 16. The wall 18 can be manufactured of epoxy resins, bakelite or any other resilient substance.

The preferred embodiment utilises four AA-size batteries 15, only two of which are illustrated in FIG. 2. The batteries 15 rest on a spring plate 19 that comprises springs 20 each of which providing connection to one terminal of each of the batteries 15. Electrical connections 21 between the springs 20 and the electronic circuit 60 pass through the spring plate 19 and the wall 18.

The switch cap assembly 30 comprises a contact block 35 and switch boss 34 and is attached to the casing 11 by a threaded connection formed of screw thread 22 on the casing 11 and corresponding screw thread 31 on the contact block 35. The threaded connection forms a waterproof seal between the exterior of the location marker 10 and the interior of the casing 11. Contact pads 32 and 33 provide connection to the other ends of the batteries 15.

Figure 3:
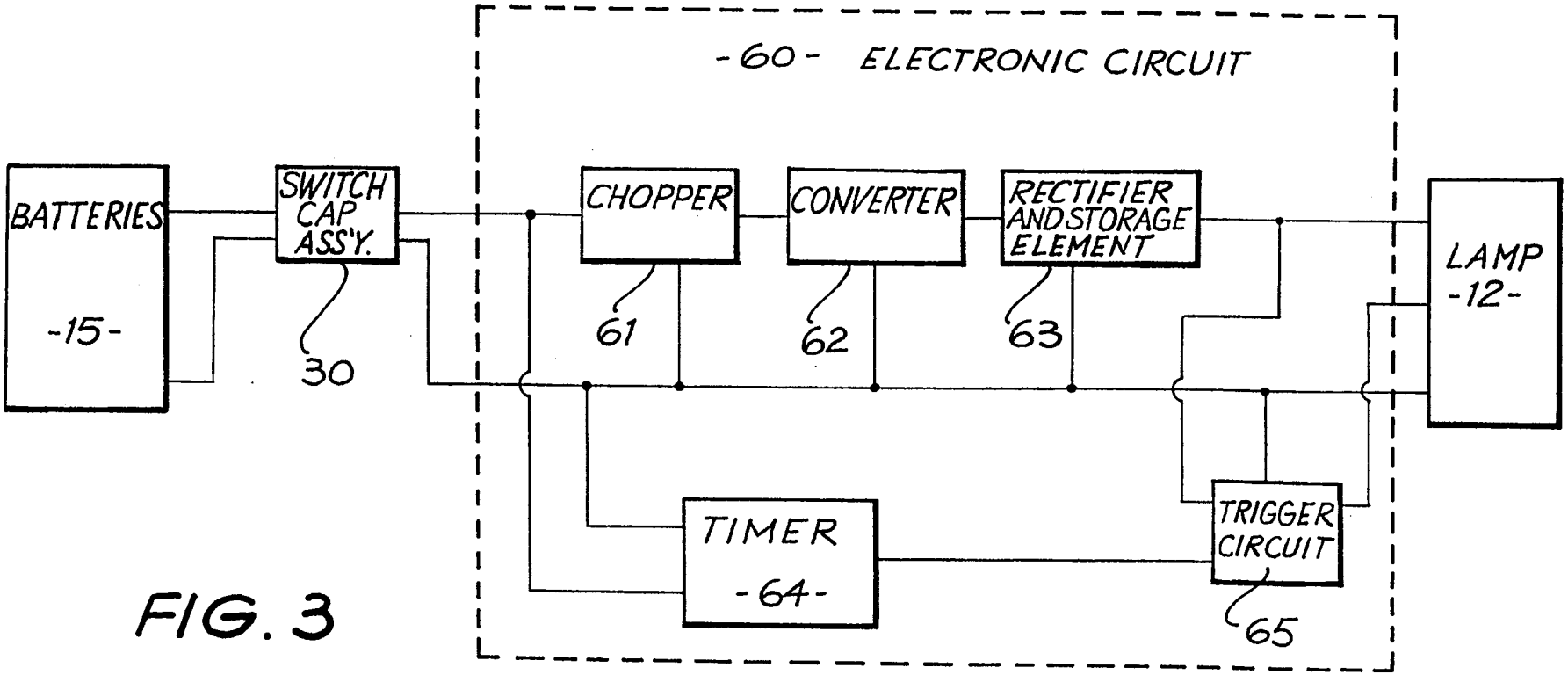
FIG. 3 is a block diagram of the complete circuit.

The electrical operation of the location marker 10 will now be described with reference to FIGS. 3 and 4 that illustrate in detail the electronic circuit 60. FIG. 3 shows, in block diagram form, the general arrangement of the electrical circuitry of the location marker 10. The batteries 15 provide electrical power via the switch 30 to the electronic circuit 60. The electronic circuit 60 comprises a chopper 61 that provides pulses of electrical energy to a converter 62 which transforms the battery voltage to a substantially higher voltage. This substantially higher voltage is then filtered by rectifier and storage element 63. A timer 64 connected to the batteries 15 via switch 30 provides triggering pulses to a trigger circuit 65 that triggers the lamp 12 into a conductive state which draws energy from the rectifier and storage element 63.

Figure 4A:
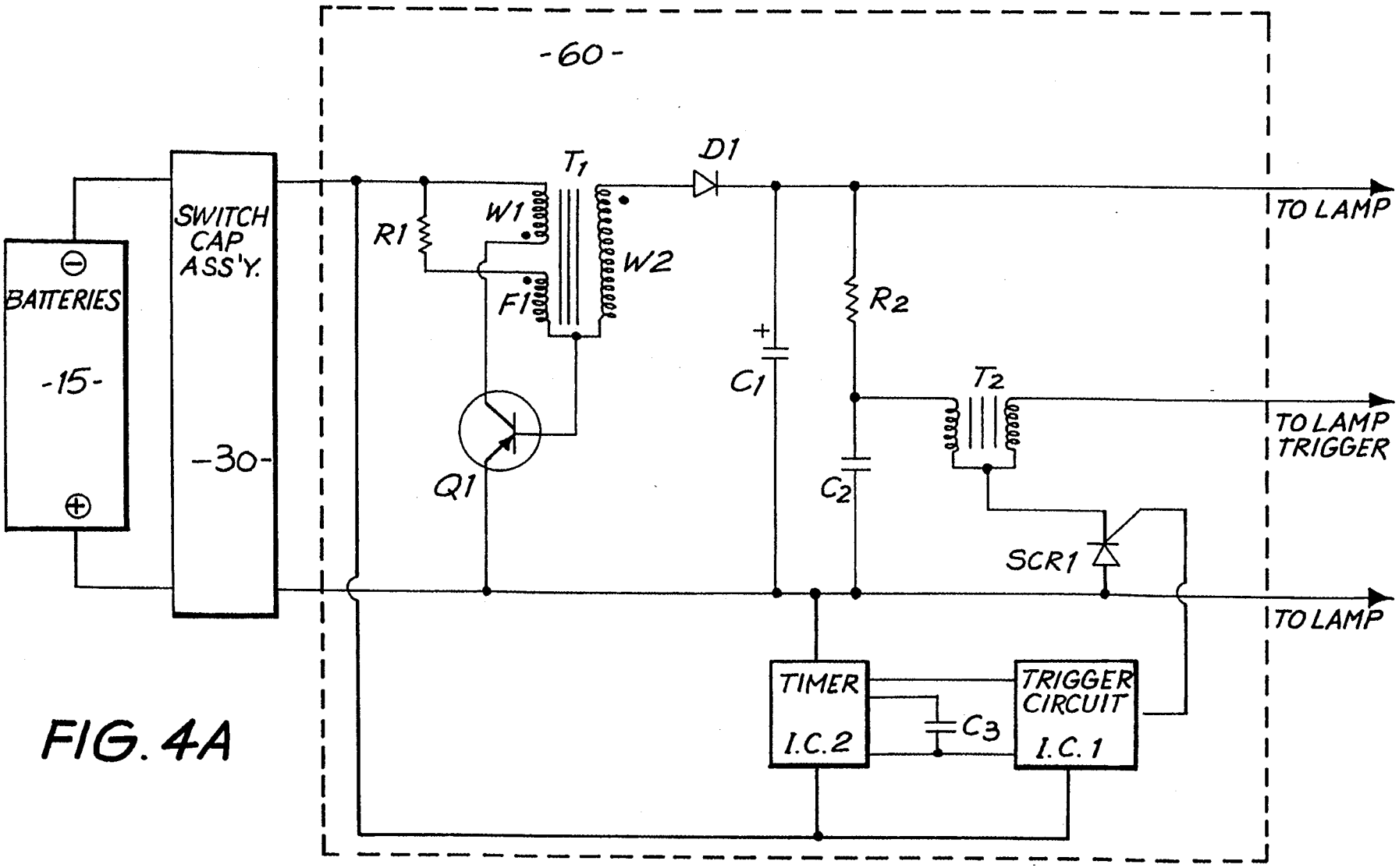
FIGS. 4A and 4B are circuit diagrams of two embodiments of FIG. 3.

One preferred embodiment of the electronic circuit of FIG. 3 is illustrated in FIG. 4A. Transformer T1, resistor R1 and transistor Q1 together form the chopper 61 and converter 62. These components create a blocking oscillator that provides a high voltage to the anode of diode D1. Together, diode D1 and capacitor C1 form the rectifier and storage element 63 and provide a filtered high voltage that is connected to one input of the lamp 12.

Integrated circuit IC2 is the timer 64 that provides trigger pulses to an opto isolator IC1. The time between the trigger pulses being determined by capacitor C3 and the voltage across IC2. As such, the period between trigger pulses increases as the battery voltage decreases, as occurs with extended usage. The opto isolator IC1 communicates the trigger pulse to the switch SCR1 that, together with transformer T2, resistor R2 and capacitor C2, forms the trigger circuit 65, and relays the trigger pulse to the lamp 12.

The lamp 12 is preferably a xenon lamp that is capable of being pulsed repeatedly over extended periods of time.

The operation of the electronic circuit 60 of FIG. 4A will now be described. Initially, all voltages and currents within the circuit 60 are at zero. When the batteries 15 are first connected across the circuit 60 upon closure of the switch 30, current initially flows from the positive terminal of batteries 15 into the emitter of Q1 to bias the base of Q1 via winding F1 and resistor R1. Q1 then conducts from emitter to collector through winding W1. The flow current through W1 first opposes current flow in F1 and once those currents achieve correspondingly proportionate magnitudes, the bias of Q1 provided by F1 is reversed switching Q1 off. Q1 switching off causes back EMF of transformer T1 to output a current through D1 to charge capacitor C1. Once the back EMF is dissipated the blocking oscillator formed by T1, Q1 and R1 reverts to it's initial state.

Timer IC2 produces a sharp, narrow pulse of repetition rate proportional to the battery voltage and the value of capacitor C3. The period between the pulse can be determined by the equation $$T = \frac{KC_3}{V}$$

where

T=period between each pulse

V=the supply voltage

K=constant determined by circuit parameters.

The pulse provided by IC2, being short and sharp, is isolated from the trigger devices by opto-isolator IC1. Furthermore, IC1 provides for further shaping of the pulse that improves it's sharpness. Due to the sharp quality of the pulse, the oscillation of the blocking oscillator 61,62 is not impeded should there be insufficient energy stored in C1 to fire the lamp 12. IC1 communicates the pulse to SCR1 which then switches on. The charge stored on C2 together with the current flowing through SCR1 induce a high voltage pulse of approximately 300 volts that is supplied to the lamp trigger via T2.

Figure 4B:
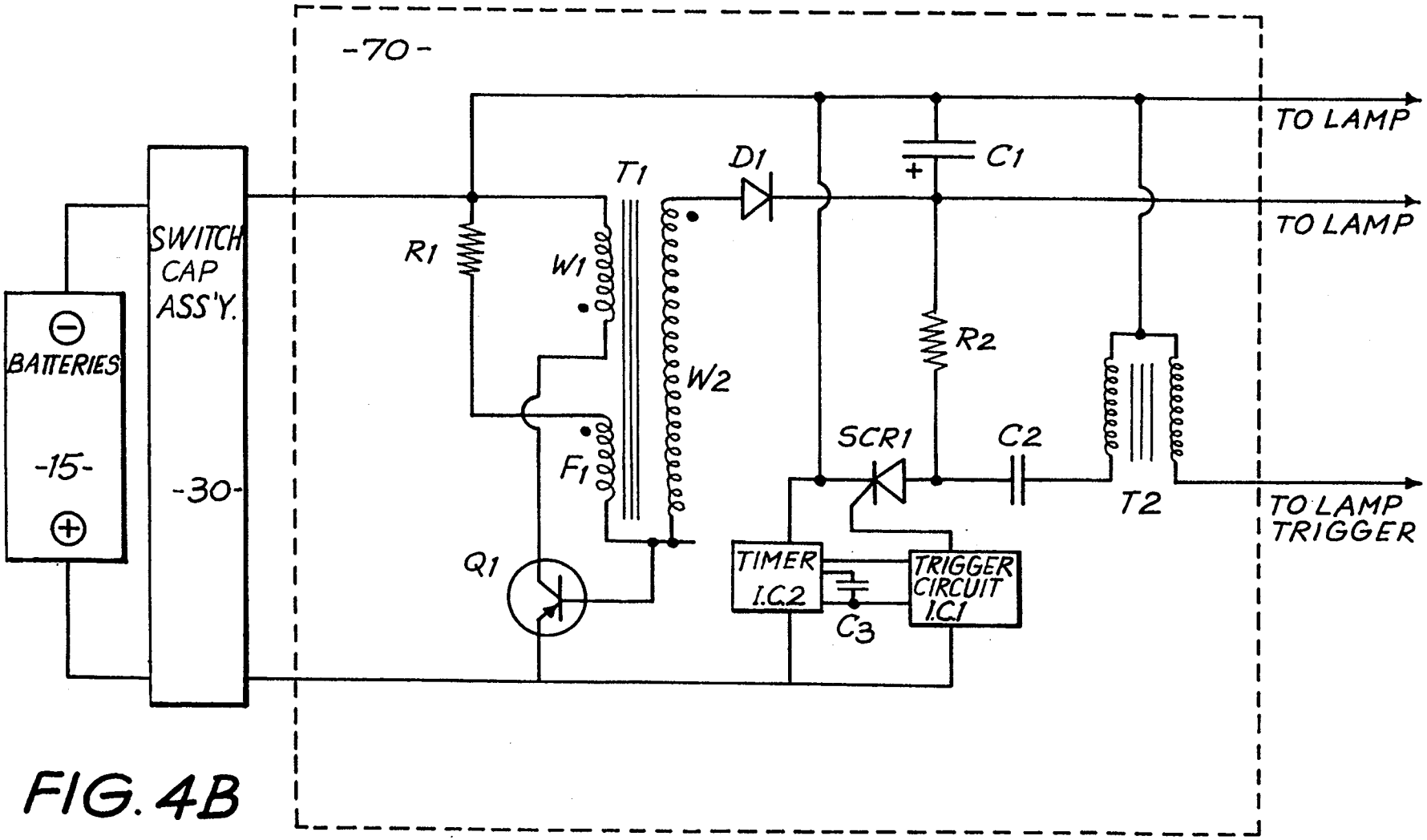

An alternate embodiment of the electronic circuit 60 is shown in FIG. 4B as circuit 70. Components are as previously described but the trigger circuit 65 has been rearranged, This embodiment provides marginally lower voltage triggering and hence longer operation than the circuit 60 of FIG. 4A.

The electronic circuits 60 and 70 have been optimised to ensure that maximum energy is transferred from the batteries 15 to the lamp 12. For example, the resonant frequency of the feedback winding F1 of transformer T1 is matched with that of the resistor R1 and the impedance presented by transistor Q1. This eliminates the need for a bypass capacitor on the base of transistor Q1 as is normally required in chopper circuits used for photographic lamps. As such, the energy dissipated in such a bypass capacitor is not wasted in the electronic circuit of the FIGS. 4A and 4B. Also, the trigger circuit allows for the blocking oscillator converter to function uninterrupted. This provides for capacitor C1 to be continually charged so that a constant amount of energy can be transferred to the lamp 12. Other non preferred circuits place the load switching device SCR1 directly off the converter 62 (T1). This unpreferred form requires high gate currents on SCR1 to ensure triggering of the device and hence illumination of the lamp 12.

The electronic circuits 60 and 70 are further optimised in the use of opto coupler IC1 that provides a short, sharp, triggering pulse to SCR1 and also provides isolation protection for the timer 64 (IC2) from voltage surges at the trigger circuit 65 (SCR1).

The optimisation of the electronic circuits 60 and 70 provide for substantially the same amount of energy to be transferred to the lamp 12 with each trigger pulse. This occurs irrespective of the age and condition of the batteries 15 and the period between the trigger pulses. As such, a constant volume of light is emitted by the lamp 12 for the entire life of the batteries 15.

Figure 5A:
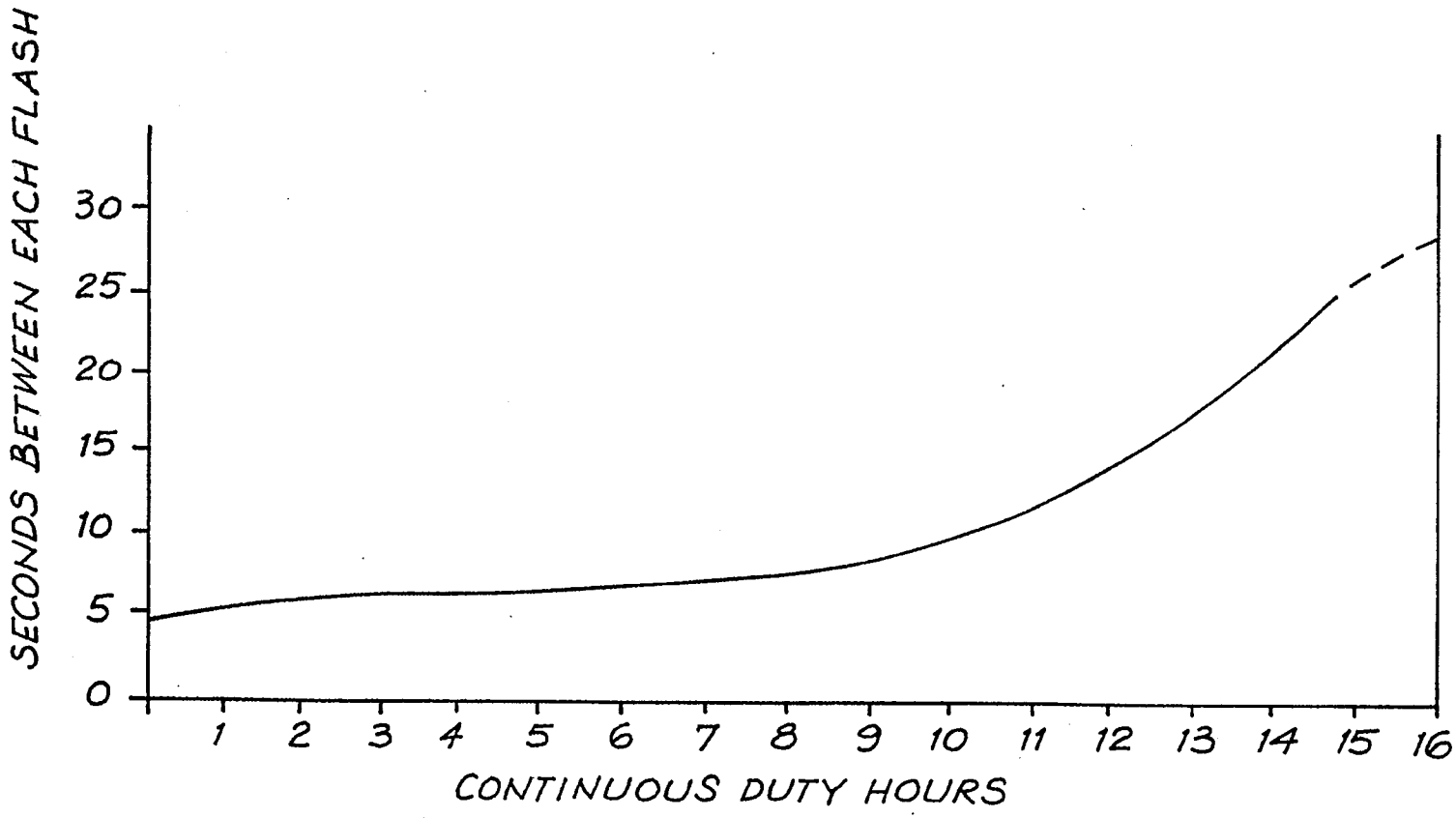
FIGS. 5A and 5B are graphs that show the performance of two embodiments of the present invention.
Figure 5B:
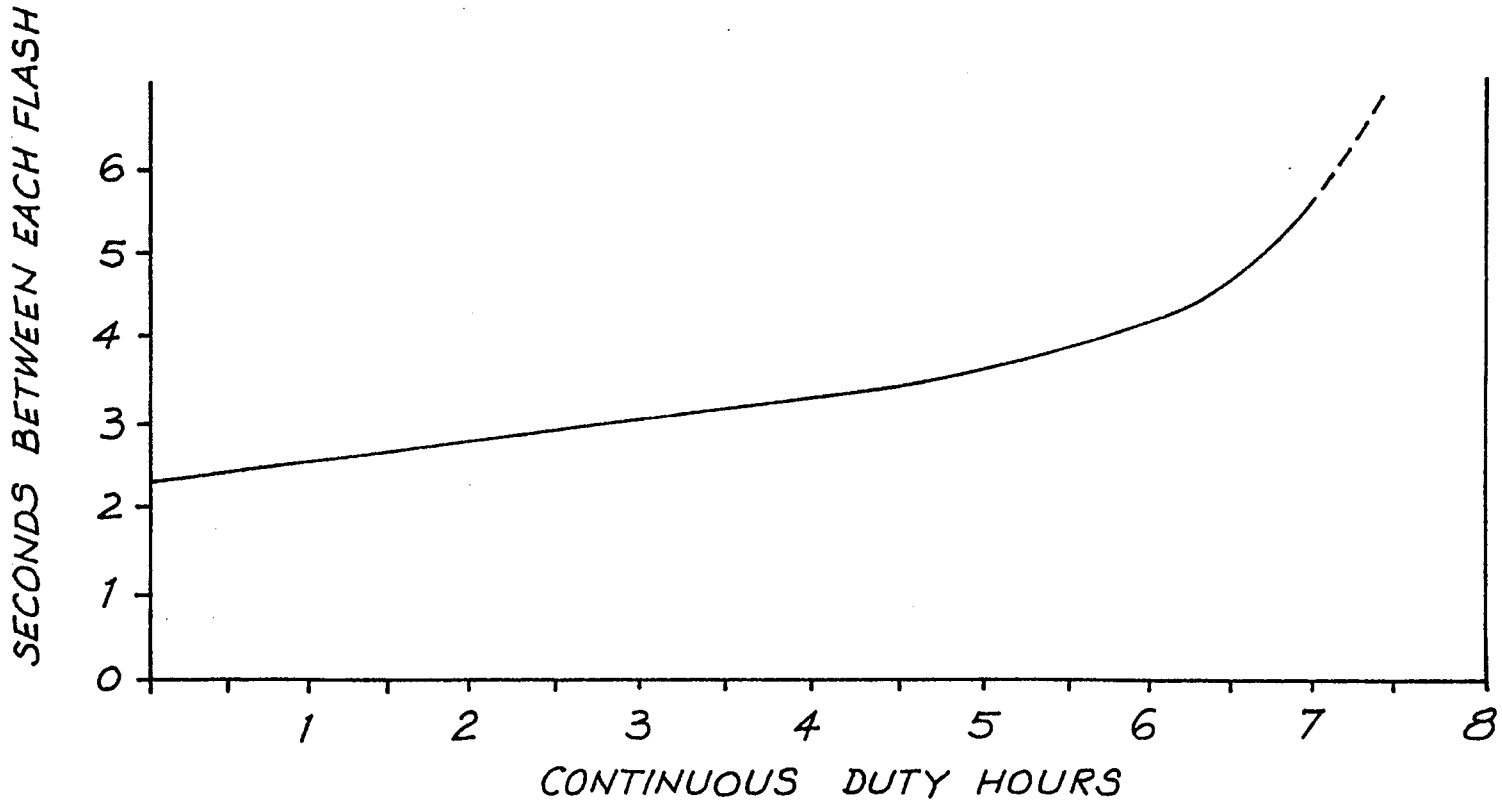

FIGS. 5A and 5B illustrate the performance of two forms of the electronic circuit 60 over a period of time. It will be seen from each of the graphs in FIGS. 5A and 5B that the period between the flashes of the lamp 12 increases as the batteries deteriorate over time. FIG. 5A illustrates a normal flash rate commencing at approximately five seconds between each flash and FIG. 5B illustrates a rapid flash rate commencing at approximately 2.3 seconds between each flash. The variation in flash rate being provided between each case by changing the value of capacitor C3 in FIGS. 4A or 4B.

Figure 6A:
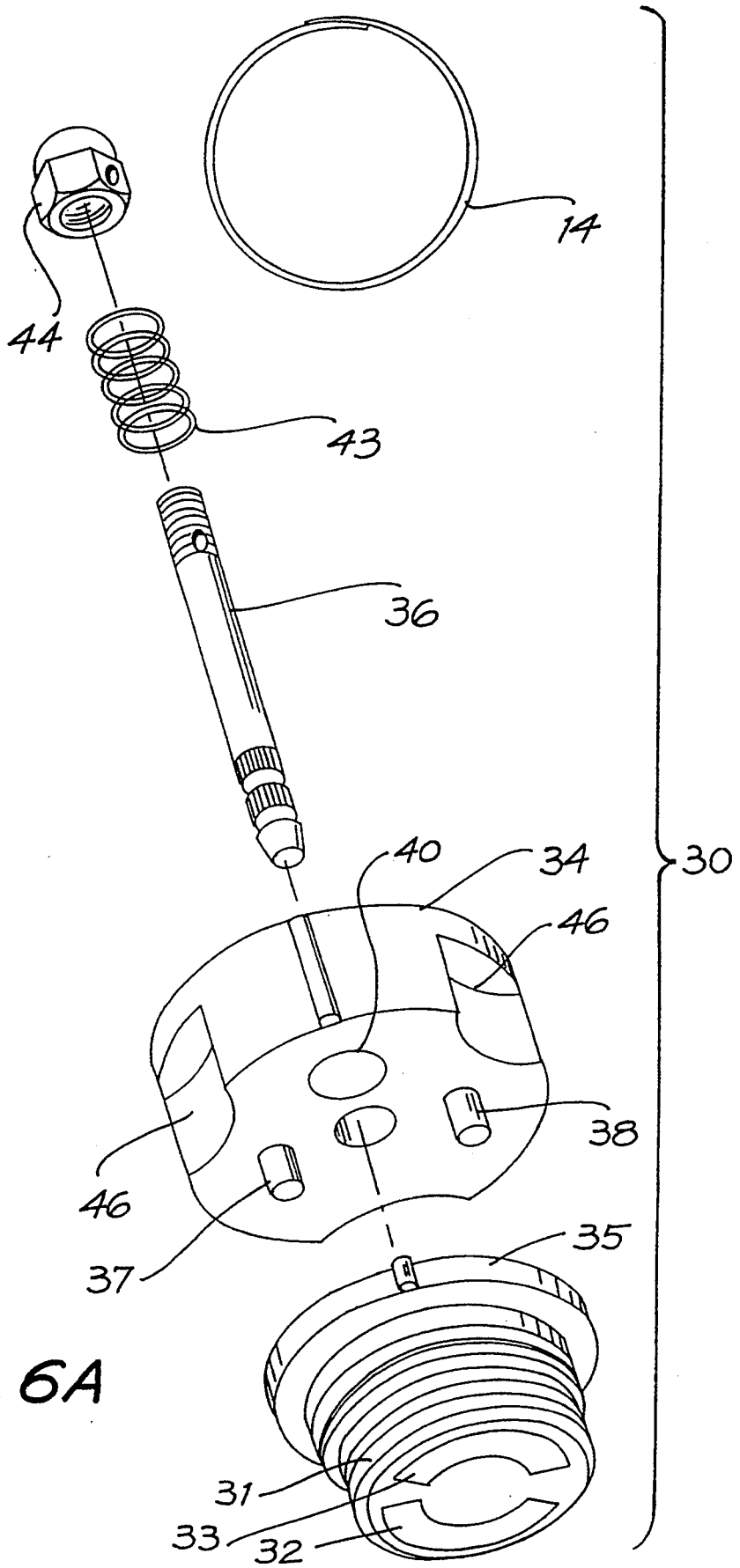
FIG. 6A is an exploded perspective illustration of the switch cap assembly.

The location marker 10 is operated by the actuation of the switch cap assembly 30. The assembly 30 is shown in an exploded perspective drawing at FIG. 6A. The assembly 30 comprises a switch boss 34 that is rotatably mounted on a contact block 35 using a spigot 36. The spigot 36 is preferably manufactured of stainless steel. The assembly 30 is resiliently held together by spring 43 and nut 44. The switch boss 34 has finger scallops 46 formed in it's circumferential surface to aid in grasping and turning the boss 34 to operate the location marker 10. The contact block 35 has on its lower face contact pads 32 and 33 that each make connection with two of the four batteries 15. The contact pads 32 and 33 are substantially hemispherical rings that provide for the entire contact block 35 to be rotated across the surface of the four batteries 15.

Located within the contact block 35 and not illustrated is a magnetically operable switch which provides electrical connection and disconnection between the contact pads 32 and 33. The magnetically operable switch is preferably a Reed Switch or a Hall Effect Device.

The switch boss 34 comprises posts 37 and 38 that protrude from an underside face of the switch boss 34 and mate with two holes 39 (illustrated in FIG. 6B) located in the upper surface of the contact block 35. With reference to FIGS. 6B and 6C, the holes 39 define two positions of rotation of the switch boss 34 over the contact block 35 about the spigot 36. Also located in the underside face of the switch boss 34 and between the posts 37 and 38 is a magnet 40 that operates the magnetically operated switch located in the contact block 35.

A vapour and water-tight seal is provided when the contact block 22 is screwed into position on the thread 22 of the casing 11. The seal is maintained by a O-ring 41 located in a corresponding groove 42 as seen in FIG. 2 of the contact block 35 adjacent its thread 31.

Those skilled in the art will understand that when the switch cap assembly 30 is assembled the switch boss 34 will be rotatable about the spigot 36 so that the magnet 40 can actuate the magnetically operated switch located in the contact block 35. This is a normal mode of operation of the location marker 10 and the electrical connections provided by this normal mode are depicted in FIGS. 7A and 7B. FIG. 7A illustrates the location of the contact pads 32 and 33 with the batteries 15*a* 15*b*, 15*c* and 15*d*, that provide power to the electronic circuit 60. Rotation of the switch boss 34 about the contact block 35 thus will close the magnetically operable switch indicated diagrammatically at 45 in FIG. 7B and complete the electrical circuit. FIG. 7B illustrates the connection of the batteries of the preferred embodiment. Spring plate connections 23 and 24 connect terminals of adjacent batteries (15*a*, 15*b*) (15*c*, 15*d*) at the spring plate 19 to which electrical connections 21 are made. The polarities indicated on batteries 15*a*, 15*b*, 15*c* and 15*d* in FIGS. 7A and 7C are those at the contact block 35 end of the battery compartment 16.

When using four standard AA batteries as the batteries 15, the preferred embodiment provides a power source of approximately three volts.

The arrangement of the contact pads 32 and 33 provide for the switch assembly 30 to be operated in an emergency mode in which the magnetically operable switch is by-passed. In this mode of operation, the entire switch cap assembly 30 is rotated through 90° about the casing 11. A counter clockwise rotation causes the contact pads 32 and 33 to be arranged as indicated in FIG. 7C. The corresponding electrical connection of the batteries 15*a*, 15*b*, 15*c* and 15*d* is depicted in FIG. 7D. It is seen from FIG. 7D that the operation of the magnetically operable switch does not impede the connection of the batteries 15 to the electronic circuit 60. A clockwise rotation of the assembly 30 produces the same electrical result, only interchanging the positions of the batteries 15*a*, 15*b*, 15*c* and 15*d*, from those illustrated in FIG. 7D.

It will be realised by those skilled in the art that the operation of the switch cap assembly 30 does not alter the vapour and water-proof security of the interior of the casing 11 and thus effectively protects the batteries 15 and electronic circuit 60. This feature is afforded by the use of the magnetically operable switch sealed within the contact block 35.

Figure 8:
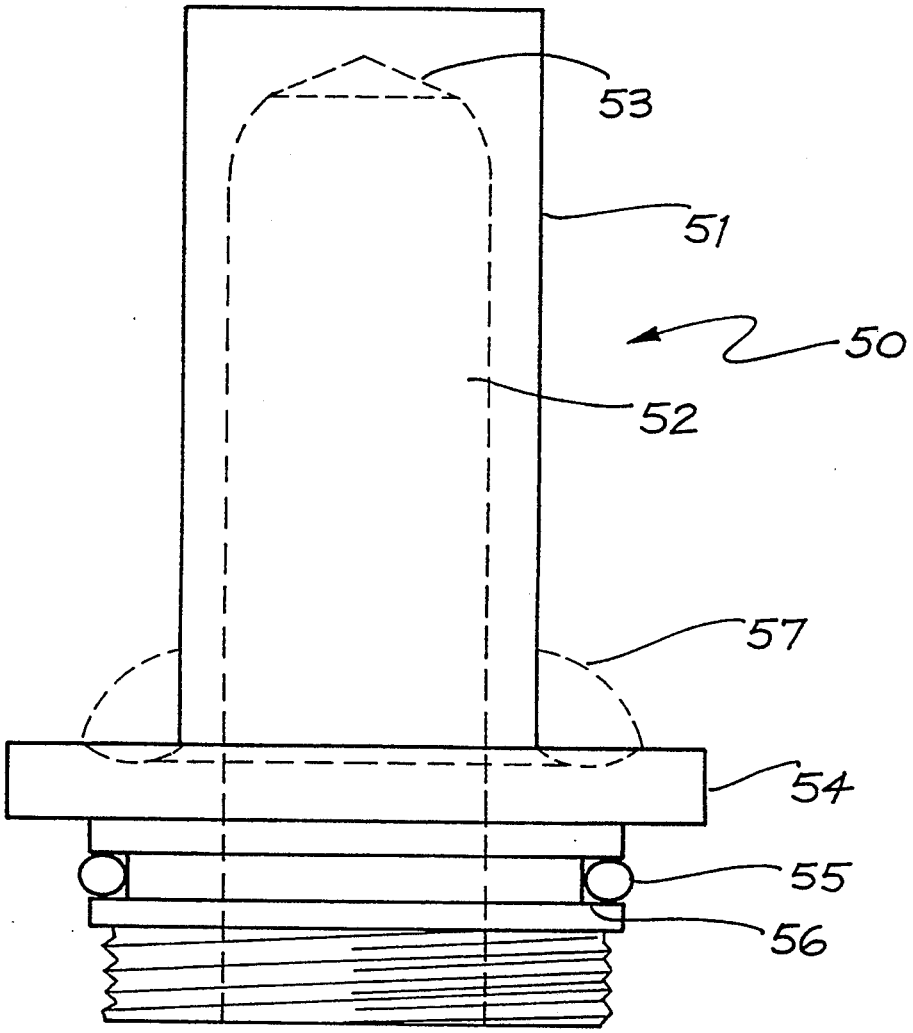
FIG. 8 is a cross section of the lens.

The location marker 10 is provided with a lens 50 that disperses light produced by the lamp 12. Referring to FIG. 8, the lens 50 is shown in longitudinal cross section. Lens 50 comprises transparent or preferably translucent plastics material formed by injection moulding or machining. The lens 50 comprises a substantially cylindrical body 51 that has a hollow interior 52 centered about the longitudinal axis of the body 51. The hollow interior 52 allows for the insertion of the lamp 12 into the lens 50. Preferably, in the closed end of the hollow interior, a cone or dome 53 is formed which affords increased dispersion of the light through the lens. It is considered that for the purposes of locating persons in distress by means of a light beacon, the dispersion of light provided by the light beacon is as Important as the intensity of the light provided by the beacon. The cone of dome 53 can be formed by further boring of the interior 52 or, as Illustrated in FIG. 2, by double-shot injection moulding of a plastics material of different refractive index to that used in the cylinder 51 of the lens 50. The base of the lens 50 comprises a flange 54 that encloses the end of the casing 11 as seen in FIG. 2. The end of the casing 11 is sealed by an O-ring 55 and corresponding recess 56 formed on the flange 54. The lens 50 is also bonded to the casing 11 by a solvent weld or other suitable means.

In an alternative configuration, the lens 50 can have shoulders 57 between the cylindrical body 51 and flange 54 that add to the dispersion of light from the lamp 12. Also, the lens can be coloured to provide for group identification when various location markers 10 are in use at any one point in time.

Figure 9:
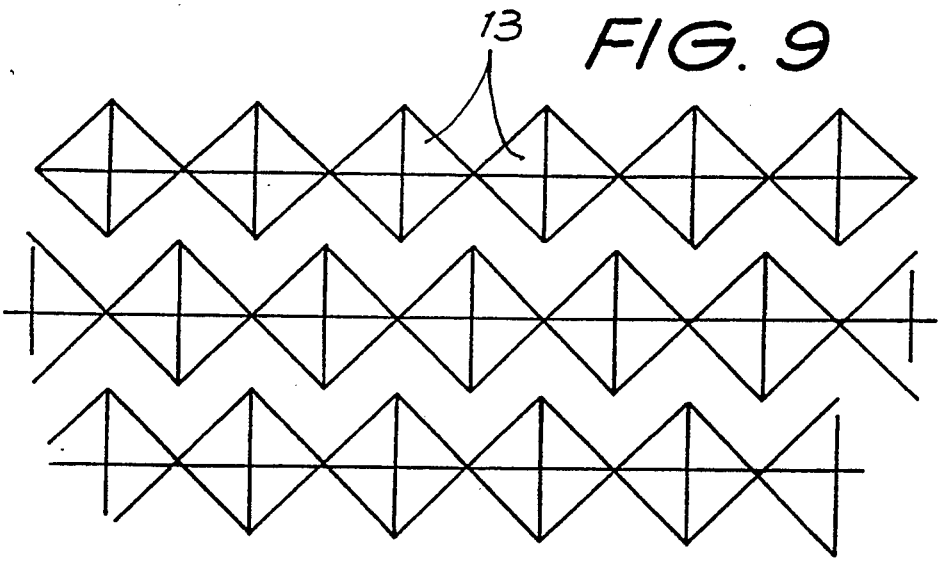
FIG. 9 illustrates the casing surface configuration.

The casing 11 is an injected moulded cylinder that has an external configuration formed of tetrahedon or pyramidal structures 13. The rows of tetrahedon structures 13 are interleaved as indicated in FIG. 9 with the spacing between these rows being tailored for maximum shedding of detretious material such as mud, snow and ice. The result being that the casing 11 is more readily grasped so that the switch cap assembly 30 can be operated even under the most testing circumstances. This is due to the interaction of the grasping hand, or gloved hand, causing a shearing action against the tetrahedon structures 13 that channels detretious material between the adjacent interleaved tetrahedons that transports such material away from the casing 11.

The casing 11 is preferably manufactured of plastics material that has a high impact resistance and can be used within broad temperature ranges. Preferably, the plastics material is Noryl N225 (Registered Trade Mark) which is useful from −50° C. to 120° C.

Also, it is preferred that the posts 37 and 38 and spigot 36 be manufactured of 316 stainless steel. The contact pads 32 and 33 and springs 20 are preferably manufactured of nickel silver which affords low electrical resistance and substantial resistance to corrosion.

The location marker 10 has achieved a safety rating of Class 1 Zone 0 and Australian Standard AS2431-1981 Electrical Equipment for Explosive Atmospheres. Also, the electronic circuit 60,70 when encapsulated meets the same standard. Also, such a device is waterproof to 150 meters.

The present invention has advantages over prior art devices in that the switch cap assembly 30 is hermetically sealed and thus protects the electrical components of the device as well as having an emergency by-pass position that can be used If the normal switch fails. Such a location marker is extremely rugged and is suitable as a distress beacon or as a location device for use in search and rescue.

The location marker 10 has negative buoyancy and thus can be used by underwater divers as top and bottom markers on a diving line. Alternatively, the location marker 10 can be provided with a float collar (not illustrated) of positive buoyancy that fits over the casing with an interference fit and provides for buoyancy of the marker such that the cylindrical body 51 of the lens 50 protrudes from the water with the flange 54 being slightly beneath the surface of the water. As such, the positioning of the flange 54 within the water adds to the dispersion of light afforded by the lens 50. Alternatively, depending upon the location of the collar about the casing 11, the location marker is buoyant with the lens 50 pointing downwards into the water. Such a use is preferred by underwater divers in provision of a "top-marker".

The foregoing describes a number of embodiments of the present invention and other embodiments, obvious to those skilled in the art, can be made thereto without departing from the scope of the present invention.

For example, lithium batteries can be used where long shelf life is required, in lifeboats for example. At the date of this application, AA-size lithium batteries are not available however C-size lithium batteries can be used by revising the arrangement of the contacts 32 and 33 and by inserting a collar around the batteries to retain them in the battery compartment 16.

Figure 10:
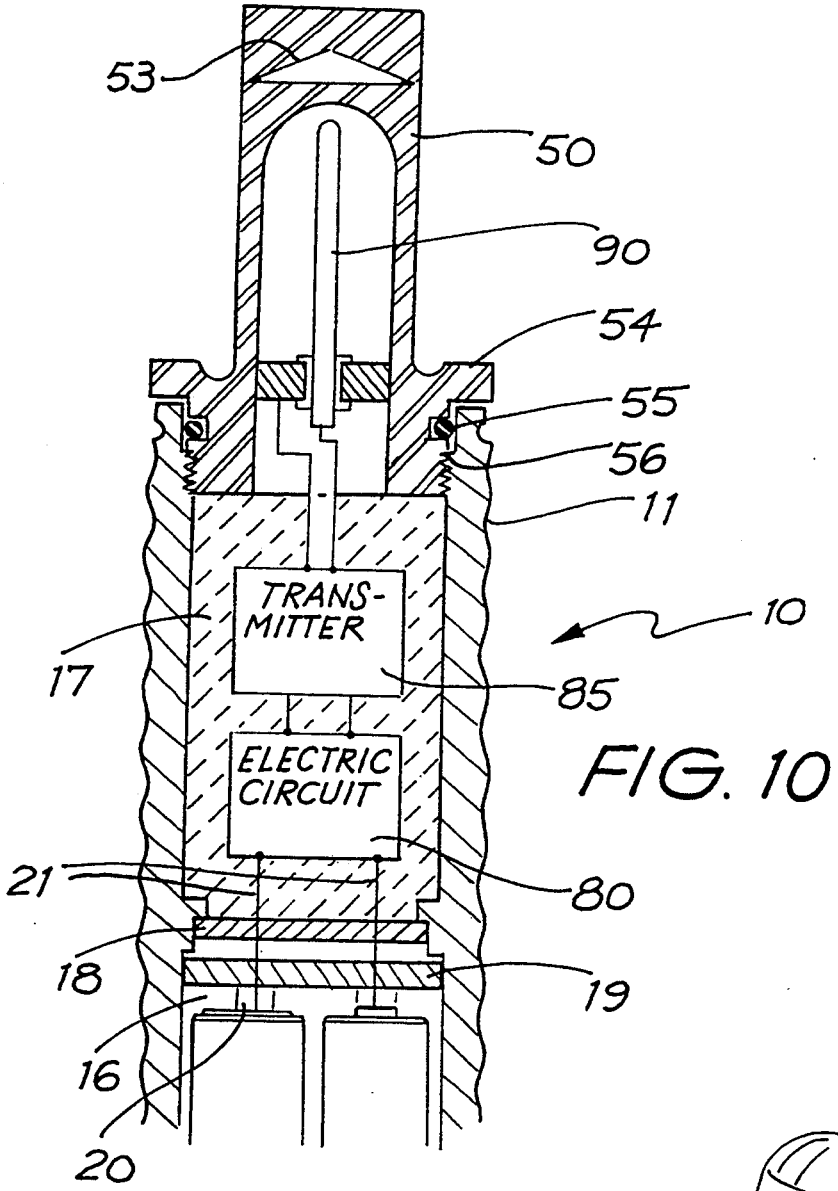
FIG. 10 is a view similar to FIG. 2 showing an embodiment of an RF transmitting location marker.
Figure 11:
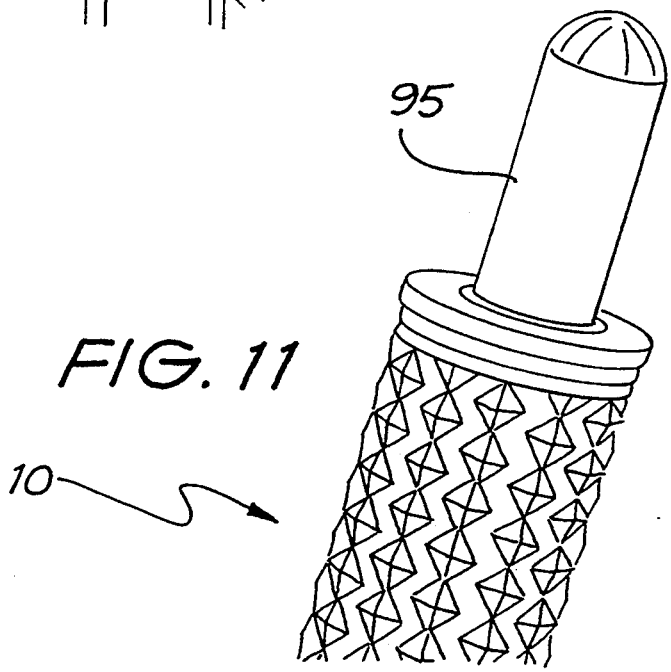
FIG. 11 is a view similar to FIG. 1, but showing an alternative antenna arrangement to that of FIG. 10.

Also the location marker 10 and electronic circuit 60 can be adapted to pulse a radio frequency transmitter, and an antenna in place of the lamp 12. FIG. 10 illustrates such an embodiment where a revised low voltage electric circuit 80, similar to circuits 60 and 70, pulses a radio frequency transmitter 85. The transmitter 85 preferably operates in the VHF or UHF bands at appropriate distress/emergency frequencies. The transmitter 85 drives an antenna 90 that can be provided in place of the lamp 12 within the lens 50. Alternatively, as illustrated in FIG. 11, the lens 50 is replaced entirely by an omnidirectional antenna 95 which is sealed to the casing 11 in the same manner as the lens 50. Due to the size of the antenna 95, frequencies of tranmission in the UHF band are preferred. Such antenna 90 and 95 together with the RF transmitter 85 will be known to those skilled in the art. This embodiment will however be distinguished from prior art transmitters by maintaining a substantially constant transmitted power for each pulse over the life of the batteries 15.

Also, the lens 50 can be provided with an infrared sleeve adapted to cover the lens 50 to prevent the escape of visible light but transmitting infrared light. Alternatively, the lens 50 can be manufactured of materials transparent to infrared light but not visible light.

I claim:

1. A signalling device comprising:

a housing enclosing a battery source and an electronic circuit;

a switch assembly for selectively connecting and disconnecting at least one pair of terminals of said source, said switch assembly comprising;

two contact pads arranged on one surface of a contact block, each of said pads adapted to contact, in a first position, one of said terminals;

a magnetically operable switch located in said contact block that provided for electrical connection and disconnection between said contact pads;

a boss rotatably connected to said contact block and rotatable between two positions, one of said positions aligning a magnet located within said boss with said magnetically operable switch, to activate said magnetically operable switch under normal operation of said device, said boss and said contact block being adapted to rotate together such that at least one of said contact pad contacts, in a second position, said terminals, to connect said source and said circuit in the event of failure of said magnetically operable switch; and a signal emitter connected to said circuit, said circuit being adapted to derive energy from said source and to supply pulses of energy to said emitter, each said pulse providing substantially uniform energizing power during the life of said source.

2. A signalling device as claimed in claim 1 further comprising a lens formed of translucent diffusing plastics material, said lens having a substantially cylindrical body, the interior of said body being adapted for the insertion of a lamp, one end of said body being sealed by said plastics material with said seal being of such thickness so as to allow for the formation within said seal of a conical or domed structure, said lens further comprising a flange formed at the other end of said body through which said lamp can project into said body, said structure and said flange substantially increasing the dispersion of light emitted by said lamp from said lens, said lamp acting as said emitter.

3. A signalling device as claimed in claim 1 wherein said boss and said contact block are rotatable to connect said source and said circuit when said magnetically operable switch has either failed or not failed.

4. A signalling device as claimed in claim 1 wherein said circuit comprises:

blocking oscillator means having an input connected to said source and an output connected to a rectifier and filter combination, said oscillator means converting the voltage of said source to a higher voltage, the output of said combination supplying said load;

timer means supplied by said source that outputs to an electronic isolation device a triggering pulse at intervals proportional to the voltage of said source, said isolation device interconnecting said timer means with a trigger device, said trigger device being connected to said higher voltage and adapted to cause a pulse of electrical energy to be dissipated by said signal emitter in response to said trigger pulse, the energy dissipated in said signal emitter being substantially equal for each consecutive pulse.

5. A signalling device as claimed in claim 1 wherein said signal emitter is a lamp.

6. A signalling device as claimed in claim 4 wherein said signal emitter comprises radio frequency transmitter means and antenna means.

7. A signalling device as claimed in claim 6 wherein said transmitter means is enclosed by said housing and said antenna means protrudes from said housing.

8. A signalling device as claimed in claim 7 wherein said antenna means is enclosed by a lens fitted to said housing.

9. A signalling device as claimed in claim 6 wherein said transmitter means and said antenna means are tuned for operation in the VHF band, or the UHF band, or both.

10. A signaling device as claimed in claim 1 wherein said battery source comprises a plurality of cells having two terminal connections that interconnect directly with said electronic circuit, and a plurality of terminals permitting interconnection of said cells by said switch assembly.

11. A signaling device as claimed in claim 10 wherein said source comprises four of said cells and said switch assembly is adapted to selectively connect and disconnect two pairs of said terminals, each said contact pad connecting in said first position one adjacent pair of said terminals, and in said second position a different adjacent pair of said terminals.

12. A switch assembly for selectively connecting and disconnecting two pairs of terminals, said assembly comprising:

two contact pads arranged on one surface of a contact block, each of said pads adapted to contact, in a first position, two adjacently located terminals;

a magnetically operable switch located in said contact block that provides for electrical connection and disconnection between said contact pads;

a boss rotatably connected to said contact block and rotatable between two positions, one of said positions aligning a magnet located within said boss with said magnetically operable switch;

said boss and said contact block being adapted to rotate together such that each said contact pad contacts, in a second position, to adjacently located terminals.

13. A switch assembly as claimed in claim 12 wherein said switch assembly is adapted to selectively connect and disconnect two pairs of said terminals of said source, each said contact pad connecting in said first position one adjacent pair of said terminals, and in said second position a different adjacent pair of said terminals.

14. In an electrical apparatus having an electrical source, the improvement comprising;

a switch assembly for selectively connecting and disconnecting two pairs of terminals, said assembly comprising;

two contact pads arranged on one surface of a contact block, each of said pads adapted to contact, in a first position, two adjacently located terminals;

a magnetically operable switch located in said contact block that provides for electrical connection and disconnection between said contact pads;

a boss rotatably connected to said contact block and rotatable between two positions, one of said positions aligning magnet located within said boss with said magnetically operable switch;

said boss and said contact block being adapted to rotate together such that each said contact pad contacts, in a second position, to adjacently located terminals.

* * * * *